US012789869B2

(12) United States Patent
Boggs et al.

(10) Patent No.: US 12,789,869 B2
(45) Date of Patent: Nov. 10, 2026

(54) TRAIN PACING FOR ENERGY OPTIMIZATION

(71) Applicant: Progress Rail Locomotive Inc., LaGrange, IL (US)

(72) Inventors: Taylor Ann Boggs, Roanoke, TX (US); Sammy Akif, Northlake, TX (US); Fernando Antonio Campos Gomide, Campinas SP (BR)

(73) Assignee: Progress Rail Locomotive Inc., LaGrange, IL (US)

( * ) Notice: Subject to any disclaimer, the term of this patent is extended or adjusted under 35 U.S.C. 154(b) by 118 days.

(21) Appl. No.: 18/778,779

(22) Filed: Jul. 19, 2024

(65) Prior Publication Data

US 2026/0021836 A1 Jan. 22, 2026

(51) Int. Cl.
*B61L 27/16* (2022.01)
*B61L 27/57* (2022.01)

(52) U.S. Cl.
CPC ..... *B61L 27/16* (2022.01); *B61L 27/57* (2022.01)

(58) Field of Classification Search
CPC ..... B61L 27/16; B61L 27/57
USPC ..... 701/20
See application file for complete search history.

(56) References Cited

U.S. PATENT DOCUMENTS 7,922,127 B2 * 4/2011 Kumar ..... B61L 15/0058 701/19
8,626,366 B2 * 1/2014 Noffsinger ..... B63B 49/00 701/123
8,630,757 B2 * 1/2014 Daum ..... B61L 15/0058 701/19
8,645,047 B2 * 2/2014 Daum ..... B61L 15/0058 701/19
12,024,214 B2 * 7/2024 Seenumani ..... B61L 15/0062
2004/0133315 A1 * 7/2004 Kumar ..... B61L 27/16 700/302
2007/0219680 A1 * 9/2007 Kumar ..... B61L 15/0058 701/19

(Continued)

FOREIGN PATENT DOCUMENTS

AU 2019200200 A1 2/2019
CN 112115156 12/2020

(Continued)

*Primary Examiner* — Kurt Philip Liethen
*Assistant Examiner* — John D Bailey

(57) ABSTRACT

Pacing movement of train consists to improve energy consumption is provided. An operating plan is simulated for one or more train consists that will encounter various stops or slowdowns required on a planned route and/or for stops or slowdowns required to prevent one train consist from interfering with another train consist. Energy consumption information associated with locations of stops or slowdowns is used to build or update the simulation to adjust locations of stops or slowdowns for each train consist to minimize the energy consumption impact of re-starts and/or speed ups to provide for an energy-efficient operation of the one or more train consists for which a simulated operating plan is generated. The simulated operating plan may be automatically or manually executed for the one or more train consists, and feedback from the one or more train consists may be provided for future operating plan simulation and execution.

20 Claims, 7 Drawing Sheets

(56) References Cited

U.S. PATENT DOCUMENTS

2007/0219682 A1* 9/2007 Kumar ..... B61L 15/0058 701/19
2007/0225878 A1* 9/2007 Kumar ..... B61L 15/0058 701/19
2007/0233335 A1* 10/2007 Kumar ..... B61L 15/0058 701/22
2008/0125924 A1* 5/2008 Daum ..... B61L 15/0058 701/19
2008/0183345 A1* 7/2008 Chandra ..... B61L 15/0058 701/19
2008/0183490 A1* 7/2008 Martin ..... B61L 15/0058 705/1.1
2008/0201019 A1* 8/2008 Kumar ..... B61L 15/0058 701/19
2008/0201028 A1* 8/2008 Brooks ..... B61L 15/0058 701/20
2009/0099825 A1* 4/2009 Bollapragada ..... B61L 27/14 703/8
2009/0125170 A1* 5/2009 Noffsinger ..... B60L 15/2045 246/182 B
2009/0299555 A1* 12/2009 Houpt ..... B61L 27/16 701/19
2010/0023190 A1* 1/2010 Kumar ..... B61L 15/0058 701/20
2011/0257869 A1* 10/2011 Kumar ..... B61C 5/00 701/103
2012/0277940 A1* 11/2012 Kumar ..... B61L 27/16 701/19
2012/0316717 A1* 12/2012 Daum ..... B60L 55/00 701/22
2013/0131898 A1* 5/2013 Kumar ..... B61C 17/12 701/20
2014/0094998 A1* 4/2014 Cooper ..... B61C 17/12 701/2
2015/0232097 A1* 8/2015 Luther ..... B60W 30/188 701/1
2015/0300830 A1* 10/2015 Fisher ..... B61C 17/12 701/123
2016/0009304 A1* 1/2016 Kumar ..... B61L 27/40 701/19
2016/0362022 A1* 12/2016 Mathews, Jr. ..... B60L 15/20
2017/0313332 A1* 11/2017 Paget ..... B61L 15/0027
2019/0176862 A1* 6/2019 Kumar ..... B61L 15/0027
2022/0063689 A1* 3/2022 Kumar ..... B61L 15/0027
2022/0073111 A1* 3/2022 Fisher ..... B61C 17/12
2023/0123561 A1* 4/2023 Fisher ..... F02D 41/0027 123/525
2023/0235708 A1* 7/2023 Lavertu ..... F02D 19/081 701/99
2025/0376198 A1* 12/2025 Goforth ..... B61L 17/00

FOREIGN PATENT DOCUMENTS

CN 117150780 A 12/2023
DE 102021118772 A1 1/2023

* cited by examiner

300

Fuel Impact by Stop Location

| Stop Location | Avg Gallons With Stop | Avg Gallons Without Stop | Stop Impact (%) |
|---|---|---|---|
| 210 | 62 | 41 | 0.87% |
| 243 | 68 | 60 | 0.35% |
| 271 | 91 | 65 | 1.13% |
| 294 | 81 | 51 | 1.30% |
| 321 | 72 | 26 | 1.96% |

FIG. 3

TRAIN PACING FOR ENERGY OPTIMIZATION

TECHNICAL FIELD

The present disclosure generally relates to managing operation of train consists. More particularly, the present disclosure relates to managing pacing of train consists through stops, starts, slowdowns, speed ups, braking, and meets and passes that optimizes fuel and/or electrical charge consumption along a train consist route.

BACKGROUND

A train consist typically includes a number of railway cars and one or more locomotives for moving the railway cars along tracks to desired locations. Railway managers are responsible for building train consists based on required cargo haulage, destinations, and schedules. In a typical situation, a given train consist encounters a series of starts, stops, slowdowns, speed ups, braking and meets and passes relative to other train consists. Speed changes are encountered for planned stops or slowdowns (e.g., loading/unloading, approaching crossings, and the like). Train consists also encounter speed changes in unplanned or undesired situations to avoid other train consists operating on the same track, to avoid other train consists operating on a crossing track, to switch a train consist from a mainline track to a siding track, and the like. Braking or throttling down a train consist to stop or slow down followed by accelerating the train consist back to a desired operating speed after the stop or slow down requires expenditure of energy (e.g., fuel and/or electrical charge). For example, if a long and heavy train consist must stop or slow down on an incline to allow another train consist to safely pass, a significant amount of energy is required to restart or speed up the train consist and to accelerate it back to the desired operating speed. In addition, other factors such as weather conditions, route conditions (e.g., terrain elevation), train consist makeup (including locomotive power), and the like affect energy consumption.

An example system for controlling a train based on a mission plan is described in Australia Patent Application No. AU2019200200A1 to Brooks, et al. titled "Method for Controlling a Powered System Based on Mission Plan" (hereafter "the '200 document"). In particular, the '200 document describes controlling a rail vehicle or other powered system based on an optimized mission plan. One embodiment relates to a method for determining a mission plan for a powered system when a desired parameter of the mission plan is unobtainable and/or exceeds a predefined limit. The method includes identifying a desired parameter prior to creating a mission plan, wherein the desired parameter may be unobtainable and/or in violation of a predefined limit and notifying an operator of the powered system and/or a remote monitoring facility of the desired parameter.

Although, the methods and systems of the '200 document describe generating an optimal plan which minimizes fuel use and/or emissions produced subject to various train consist operational attributes (e.g., speed limit constraints, power (notch) settings, and the expected fuel used and emissions generated, the '200 document does not describe simulation and execution of an operating plan for one or more train consists that adjusts (where possible) locations of stops and/or slowdowns required for the one or more train consists relative to one or more other train consists where adjusted stops and/or slowdowns locations allow for improved energy consumption during re-starts and/or speed ups after stops or slowdowns. As a result, the methods and systems described in the '200 document do not provide for pacing a train consist to improve energy efficiency where pacing includes stopping, starting, slowing down and speeding up train consists at locations that optimize energy consumption.

Examples of the present disclosure are directed to overcoming the deficiencies described above.

SUMMARY OF THE INVENTION

According to examples of the present disclosure, pacing movement of train consists to improve energy consumption is provided. Energy consumption associated with train consist starts, stops, slowdowns, speed ups, and braking is measured and stored for one or more train consists. Measured and recorded energy consumption information (e.g., for fuel and/or electrical charge) is provided to a train pacing system (e.g., a driving strategy engine and/or train pacing model). A network planning engine simulates an operating plan for one or more train consists comprising a network of train consists operating in a same area during overlapping schedules where one or more train consists will encounter various stop or slow down locations required for planned stops (e.g., for loading and/or unloading cargo) and/or for stops or slowdowns required to prevent one train consist from interfering with the travel of another train consist operating on the same track or on a crossing or neighboring track. The simulated operating plan considers train consist makeup, power requirements, route attributes (e.g., terrain, elevation changes, distance, etc.) as well as operational speed limits along planned routes.

The network planning engine queries the train pacing system for energy consumption information associated with stops or slowdowns required when approaching stop or slow down locations (e.g., location of a meet and pass with another train consist operating on the same track, or the location of a crossing of another track or road) followed by starts and/or speed ups after passing the stop or slow down locations. Energy consumption information received from the train pacing system is used by the network planning engine to update the simulation to adjust (where possible) stop or slow down locations for each train consist of the network of train consists to minimize the energy consumption impact of stops, starts, slowdowns, speed ups, and braking to provide for an energy efficient operation of the one or more train consist comprising the network of train consists for which simulated operating plan is generated. For example, if a stop or slow down followed by a restart and/or speed up of a given train consist will occur on a steep incline when the given train consist meets and passes another train consist, then the simulated operating plan for the two meeting and passing train consists may be updated so that the meet and pass location is moved to a location that does not include a steep incline. Thus, restarting or accelerating one or both of the meeting and passing train consists after the meet and pass location will require less energy consumption for one or both of the train consists.

After the simulated operating plan is updated, the network planning engine sends the simulated operating plan to the locomotives responsible for moving the one or more train consists comprising the network of train consists. That is, each locomotive receives an individualized operating plan as part of the overall simulated operating plan for its train consist separate from other individualized operating plans for other train consists comprising the network of training consists. At the locomotives, the simulated operating plans are executed and the stops, starts, slowdowns, speed ups and braking for each locomotive may be automated to run according to the simulated operating plans. Alternatively, if the locomotives are operated manually, then the simulated operating plans may provide recommended throttling and braking to train engineers to allow them to operate the locomotives according to the simulated operating plans. A locomotive management system on board each locomotive may monitor and record energy consumption along respective train consist routes, and recorded energy consumption information may be used for informing and improving simulated operating plans for future train consists.

In some examples, systems and techniques described herein may provide a method of pacing movement of a train consist. A request is received for a train consist including one or more railway cars and one or more locomotives. One or more operating parameters is/are received for the requested train consist. An operating plan is determined for the requested train consist based on the one or more operating parameters, the operating plan including one or more stops along a route of the requested train consist. A train pacing system is queried for an energy consumption impact for each of the one or more stops along the route of the requested train consist. If the energy consumption impact for the any of the one or more stops along a route of the requested train consist exceeds a prescribed energy consumption impact, the operating plan is modified to move the any of the one or more stops along a route of the requested train consist to a different stop location where an energy consumption impact for the different stop does not exceed the prescribed energy consumption impact.

After modifying the operating plan, the requested train consist is operated according to the modified operating plan. Operating the requested train consist according to the modified operating plan may include adjusting throttle settings and braking settings for one or more locomotives included in the requested train consist according to the modified operating plan. Operating the train consist also may include automating operation of one or more locomotives included in the requested train consist according to the modified operating plan including automating locomotive throttling and braking operations based on the modified operating plan. Alternatively operating the requested train consist according to the modified operating plan may include manually operating one or more locomotives included in the requested train consist according to the modified operating plan including recommending locomotive throttling and braking operations required for operating the requested train consist based on the modified operating plan.

During operating the requested train consist according to the modified operating plan, energy consumption information for the requested train consist is monitored and stored. The stored energy consumption information is passed to the train pacing system where it may be used for training the train pacing system and for providing energy consumption information for subsequent train consists.

Determining an energy consumption impact of each stop encountered by the requested train consist along the route of the requested train consist includes determining an energy consumption required for bringing the requested train consist to a stop at each of the one or more stops along the route of the requested train consist and for accelerating the requested train consist to a desired operating speed after bringing the requested train consist to a stop, and comparing the determined energy consumption to an overall energy consumption required for operating the requested train consist according to the modified operating plan without the stop for which the energy consumption is determined. The determined energy consumption impact of each stop encountered by the requested train consist may be stored for use by the train pacing system for providing an energy consumption impact for one or more stops included in a subsequent requested train consist.

In other examples, a system is provided for pacing movement of a train consist. A network planning system is operative to receive a request for a train consist including one or more railway cars and one or more locomotives, to receive one or more operating parameters for the requested train consist, and to determine an operating plan for the requested train consist based on the one or more operating parameters, the operating plan including one or more stops along a route of the requested train consist. The network planning system is further operative to query a train pacing system for an energy consumption impact for each of the one or more stops along a route of the requested train consist and to determine whether any of the one or more stops is associated with an energy consumption impact that exceeds a prescribed energy consumption impact for the requested train consist. If any of the one or more stops is associated with an energy consumption impact that exceeds a prescribed energy consumption impact for the requested train consist, the network planning system is operative to modify the determined operating plan to include changes of stop locations for any of the one or more stops associated with an energy consumption impact that exceeds a prescribed energy consumption impact so that an overall energy consumption for the requested train consist does not exceed a prescribed overall energy consumption.

According to this example, the network planning system is further operative to transmit the modified determined operating plan to a locomotive of the requested train consist. At the locomotive, an onboard locomotive management system is operative to receive the modified determined operating plan from the network planning system and to automate operation of the locomotive, including automation of locomotive throttling and braking settings to operate the locomotive according to the modified determined operating plan. The onboard locomotive management system is further operative to monitor and store energy consumption information for the requested train consist along the route of the requested train consist and to transmit the stored energy consumption information to the network planning system for use in determining and operating plan for one or more subsequent train consists.

In other examples, a method of training and utilizing a train pacing model is provided. At the train pacing model, energy consumption information is received from one or more completed or in-process train consist runs. Energy consumption impacts are generated associated with bringing the one or more completed or in-process train consist runs to a stop at each of one or more stops along routes of the one or more completed or in-process train consist runs and for accelerating the one or more completed or in-process train consist runs to desired operating speeds after bringing the one or more completed or in-process train consist runs to a stop. The train pacing model is updated with the generated energy consumption impacts. A query may be received at the train pacing model for energy consumption impacts for bringing a requested train consist to one or more stops and for accelerating the requested train consist to a desired operating speed after the one or more stops.

Executing the query at the train pacing model may provide energy consumption impacts associated with operating the requested train consist according to the one or more stops of the requested train consist. In response to executing the query at the train pacing model energy consumption impacts associated with operating the requested train consist according to the one or more stops of the requested train consist, energy consumption impacts may be provided associated with operating the requested train consist according to the one or more stops of the requested train consist. In addition, throttling and braking settings may be provided for one or more locomotives included in the requested train consist for operating the requested train consist according to the provided energy consumption impacts.

Prior to generating energy consumption impacts, the train pacing model may determine an energy consumption required for bringing the one or more completed or in-process train consist runs to a stop at each of one or more stops along routes of the one or more completed or in-process train consist runs and for accelerating the one or more completed or in-process train consist runs to desired operating speeds after bringing the one or more completed or in-process train consist runs to a stop. The determined energy consumption may be compared to an overall energy consumption required for operating the one or more completed or in-process train consist runs along routes of the one or more completed or in-process train consist runs.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

FIG. 3 illustrates a data table showing fuel consumption incurred at stop and slowdown locations illustrated in FIG. 2, according to examples of the present disclosure.

DETAILED DESCRIPTION

Figure 1:
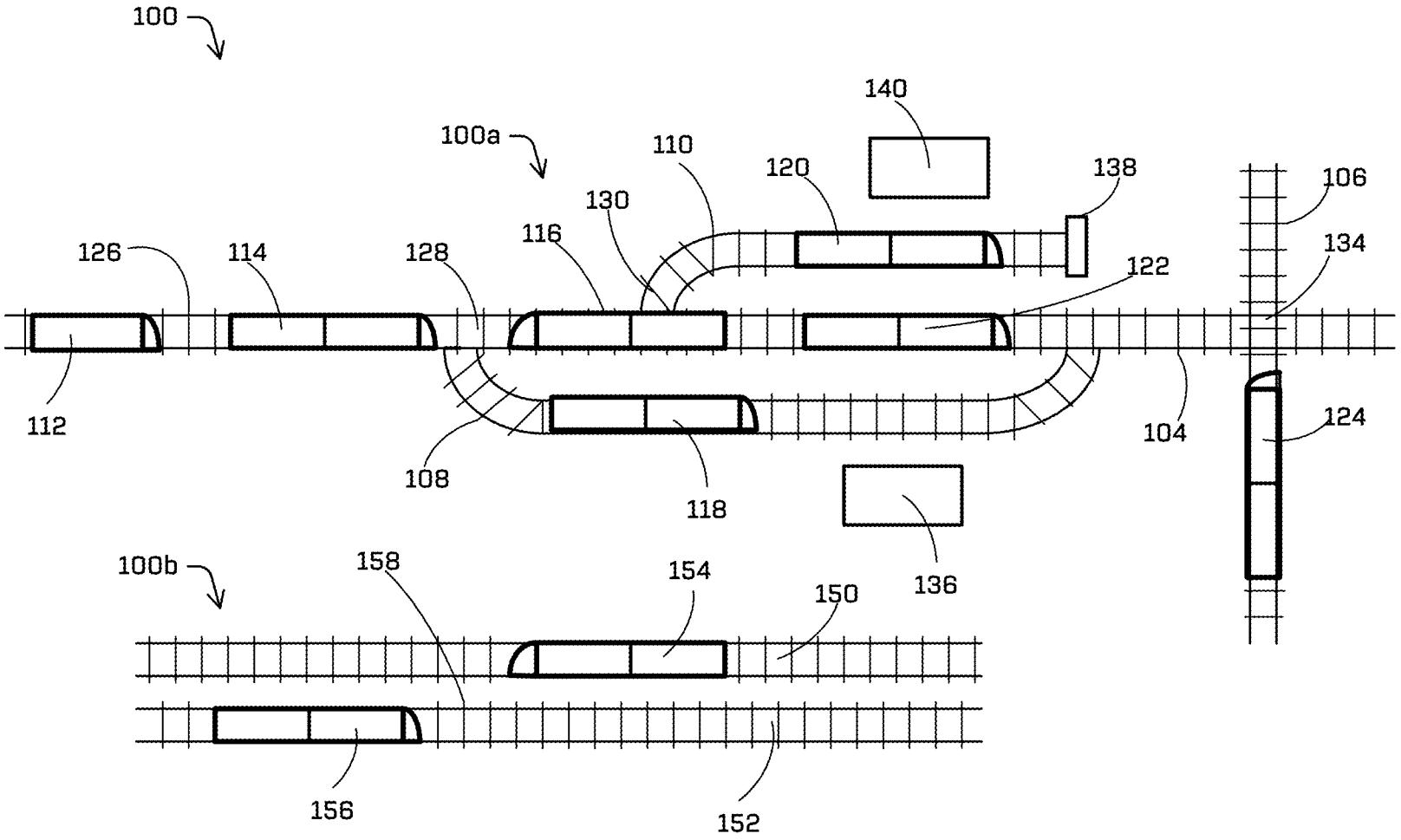
FIG. 1 illustrates an example railway system showing a plurality of train consists operating as part of a network of train consists, according to examples of the present disclosure.

According to examples of the present disclosure, a train consist typically is made up of a number of railway cars and one or more locomotives for driving the railway cars. In a given situation, a plurality of train consists may be operating in a same area, for example, in a city, at or near a railyard where train consists are built, at locations where railway cars are loaded and/or unloaded, or in open areas where the plurality of train consists interact with each other on same or neighboring tracks. In such situations, a first train consist may be required to stop or slow down to exit a track for loading or unloading or to allow a second train consist to meet and pass the first train consist. Stopping, starting, slowing down, speeding up, or braking a train consist consumes various amounts of energy (e.g., fuel and/or electrical charge) depending on the conditions of such movements. For example, if a first train must slow down or stop to allow a second train consist to meet and pass the first train consist, depending on route conditions (e.g., terrain elevation, curves, etc.), energy consumption may be excessive, and thus, locating a better location for such a meet and pass between the first and second train consists may allow for optimization of energy consumption for the first and second train consist.

According to examples of the present disclosure, fuel and/or electrical charge consumption (hereinafter referred to as energy consumption) for a given train consist as it passes along the route is measured. Energy consumption associated with stops, starts, slowdowns, speed ups, and braking (hereafter referred to as speed changes) associated with terrain changes and speed limit variations along a train consist route are measured. Measured energy consumption is associated with other attributes of the train consist, for example, train consist length (e.g., numbers and positions of railway cars and locomotives), locomotive power availability, route length, route terrain, planned speed changes, and the like. That is, for any given train consist, an energy consumption profile may be generated that measures energy consumption in association with these other attributes of the train, as energy consumption will differ depending on the makeup and operations of the train consist.

According to a particular example, energy consumption resulting from speed changes caused by train traffic where, for example, a train consist must stop and restart or slow down and speed up because of a meet and pass with another train consist is measured and stored. As should be appreciated, a meet and pass may include bringing a train consist to a stop to allow another train consist on the same track to stop for unloading, loading or maintenance or to allow another train consist on the same track to stop or slow down as it exits onto a track siding, or to allow another train consist operating on a crossing track to pass safely, or the like. Energy consumption under all such conditions for the train consist are fed into a database for access by a train pacing system (e.g., driving strategy engine and/or into a train pacing model). Energy consumption for a vast number of other train consists operating in varying route conditions and varying speed changes conditions is likewise stored in a database for use by the train pacing system (and the driving strategy engine or the train pacing model). Feeding these operating data into the train pacing system database allows the driving strategy engine to assist in developing future train consist operating plans. Feeding these operating data into the train pacing model teaches or updates the train pacing model.

After the driving strategy engine receives these operating data, or after the train pacing model is trained and updated with received operating data, operating plans for future train consists may be developed. The driving strategy engine may be queried for energy consumption data associated with a planned train consist operation. The driving strategy engine may respond by searching a database of stored energy consumption data for previous train consists having same or similar train consist makeups and power requirements and same or similar speed changes (e.g., stops and restarts or slowdowns and speed ups). Similarly, the train pacing model may be queried for energy consumption data associated with a planned train consist operation. The train pacing model may respond by using the content of the query to return energy consumption data matching the attributes of the planned train consist for which an operating plan is being developed including synthesizing energy consumption data for the planned train consist based on train consist learnings from previous train consists having same or similar train consist makeups and power requirements and same or similar speed changes (e.g., stops and restarts or slowdowns and speed ups).

According to examples of the present disclosure, a network planning engine may be utilized for generating an operating plan for one or more planned train consists. If the one or more planned train consists will be operating in a same area with overlapping schedules, then the network planning engine builds into an operating plan any planned stops or slowdowns, as well as stops or slowdowns required to allow train consists to avoid other train consists operating on the same tracks according to similar schedules. As described herein, under typical conditions, a number of train consists may operate in a same area of operation where a first train consist must slow down or stop to allow the first train consist to exit its current track for loading or unloading, or the first train consist may have to stop or slow down to prevent it from contacting a second train consist operating on the same track, or to allow the second train consist to stop or slow down for exiting the track for loading and/or unloading. Or the first train consist may need to stop or slow down to allow it to meet and pass the second train consist. Restarting, speeding up, or other speed variations for one or more train consists after they have been stopped or slowed down consumes varying amounts of fuel and/or electrical charge (energy consumption).

According to examples of the present disclosure, the network planning engine may simulate an operating plan for all planned train consists operating in a same area according to a network plan. The simulation provides for operating parameters for each train consist including train consist makeup and including locations of stops, slowdowns, and meets and passes such that the energy consumption resulting from subsequent starts and/or speedups of train consists is done in a manner that optimizes energy management of individual train consists and of the plurality of train consists making up the network plan. After generating an initial operating plan for each planned train consist, the network planning system may query the driving strategy engine or train pacing model for energy consumption information for the planned one or more train consists. In response to the query, the driving strategy engine or train pacing model may return energy consumption and energy impact data for the one or more train consists, including energy consumption data associated with speed changes caused by stops, slowdowns, restarts, speed ups and braking. If excess energy will be required to restart or speed up a stopped or slowed train consist based on the location of the stop or slow down, the network planning engine may iteratively modify the operating plans for the planned train consists to move locations of stops or slowdowns to locations requiring less energy consumption for subsequent restart or speedup. As should be appreciated, with each modification of the operating plans for the planned train consists, the network planning engine may query the driving strategy engine or train pacing model for updated energy consumption data.

According to examples, after a final operating plan for the one or more train consists is simulated by the network planning engine, the final plans for each of the one or more planned train consists are sent to locomotives for each of the one or more train consists. The locomotives may be automated to run according to the received plans. Alternatively, if the locomotives are operated manually, then the received plans may be utilized to recommend throttling and braking settings to train consist engineers according to the final operating plans. As the train consists are operated automatically or manually, energy consumption is monitored and recorded. During or after completion of routes for each train consist, recorded energy consumption information may be passed back to the driving strategy engine and/or the train pacing model with which operating plans for future train consists may be developed and executed.

FIG. 1 illustrates an example railway system 100 showing a network of train consists operating according to a network plan that optimizes energy management of the train consists through various stops, starts, slowdowns, speed ups, braking and meets and passes according to examples of the present disclosure. As illustrated in FIG. 1, the railway system 100 includes a railway section 100*a* comprised of a first mainline track 104 crossing a second mainline track 106. As should be appreciated, each of the first and second mainline tracks 104, 106 may allow for train traffic from a variety of origin locations to a variety of destination locations. A plurality of train consists 112, 114, 116 and 122 are illustrated traveling on the first mainline track 104. A siding track 108 is illustrated that allows a train consist 118 to exit the mainline track 104 to allow a train consist 114 to pass the exiting train consist 118, or to allow a train consist 116 operating on the same mainline truck 104 in the opposite direction (i.e., meeting the train consist 118 head-on) to meet and pass the train consist 118.

In addition, the siding track 108 may allow the exiting train consist 118 to stop at a location 136 where cargo may be loaded, unloaded or where train maintenance or other actions may be accomplished. The siding track 108 is illustrated as exiting and reentering the mainline track 104 to allow the train consist 118 to exit and reenter the mainline track 104. A second siding track 110 is illustrated that stops at a track stop 138. The second siding track 110 may be used for directing a train consist 120 to a stop location 140 where the train consist 120 may be loaded, unloaded, or where train maintenance or other actions may be accomplished. A train consist 122 is illustrated as traveling toward a crossing 134, and a train consist 124 is illustrated on the second mainline track 106 traveling toward the crossing 134.

The train consists 112, 114, 116, 118, 120, 122, 124 may operate independently or as part of a network of train consists each of which may encounter one or more speed changes (e.g., stops, starts, slowdowns, speed ups, meets and passes, and braking) along planned routes. According to examples of the present disclosure, operating plans are simulated for and executed by the one or more train consists to optimize energy consumption associated with speed changes along planned routes. For example, a location 126 may require the train consist 112 to stop or slow down to avoid contact with the train consist 114. The location 128 may require the train consist 114 to slow down for exiting onto the siding track 108 to allow the train consist 116 to pass the oncoming train consist 114 safely. Likewise, the locations 130, 132 may require train consists to stop or slow down to allow one or more train consists to exit or enter the mainline track 104 while other train consists pass. The crossing 134 may require a train consist 122, 124 to stop or slow down to allow another train consist 122, 124 to pass through the crossing 134 safely.

Referring still to FIG. 1, the railway section 100*b* illustrates two parallel tracks 150, 152 on which are illustrated train consists 154, 156 traveling in opposite directions. A location 158 is illustrated where the two train consists 154, 156 meet and pass traveling in opposite directions. In some situations, two train consists traveling in opposite directions on two parallel tracks may need to slow down as they meet and pass, for example, at location 158. As should be appreciated, the railway sections 100*a* and 100*b* along with the illustrated railway configurations and train consists are for purposes of example only and are not limiting of a vast number of different railway configurations and operating train consists according to examples the present disclosure.

According to examples of the present disclosure, operation of train consists comprising a network of train consists operating in a same area with overlapping schedules, as illustrated in FIG. 1, may be managed so that speed changes (e.g., starts, stops, slowdowns, speed ups, braking and meets and passes) are accomplished to allow the various train consists to travel relative to each other in a manner that optimizes energy consumption (i.e., fuel and/or electrical charge consumption) that is affected by the restarts, or speed ups of train consists that have stopped or slowed down as described above. According to examples, the energy consumption information of various train consists operating according to various speed changes may be monitored and stored and may be used for simulating and executing operating plans for future train consists in an energy efficient manner.

Figure 2:
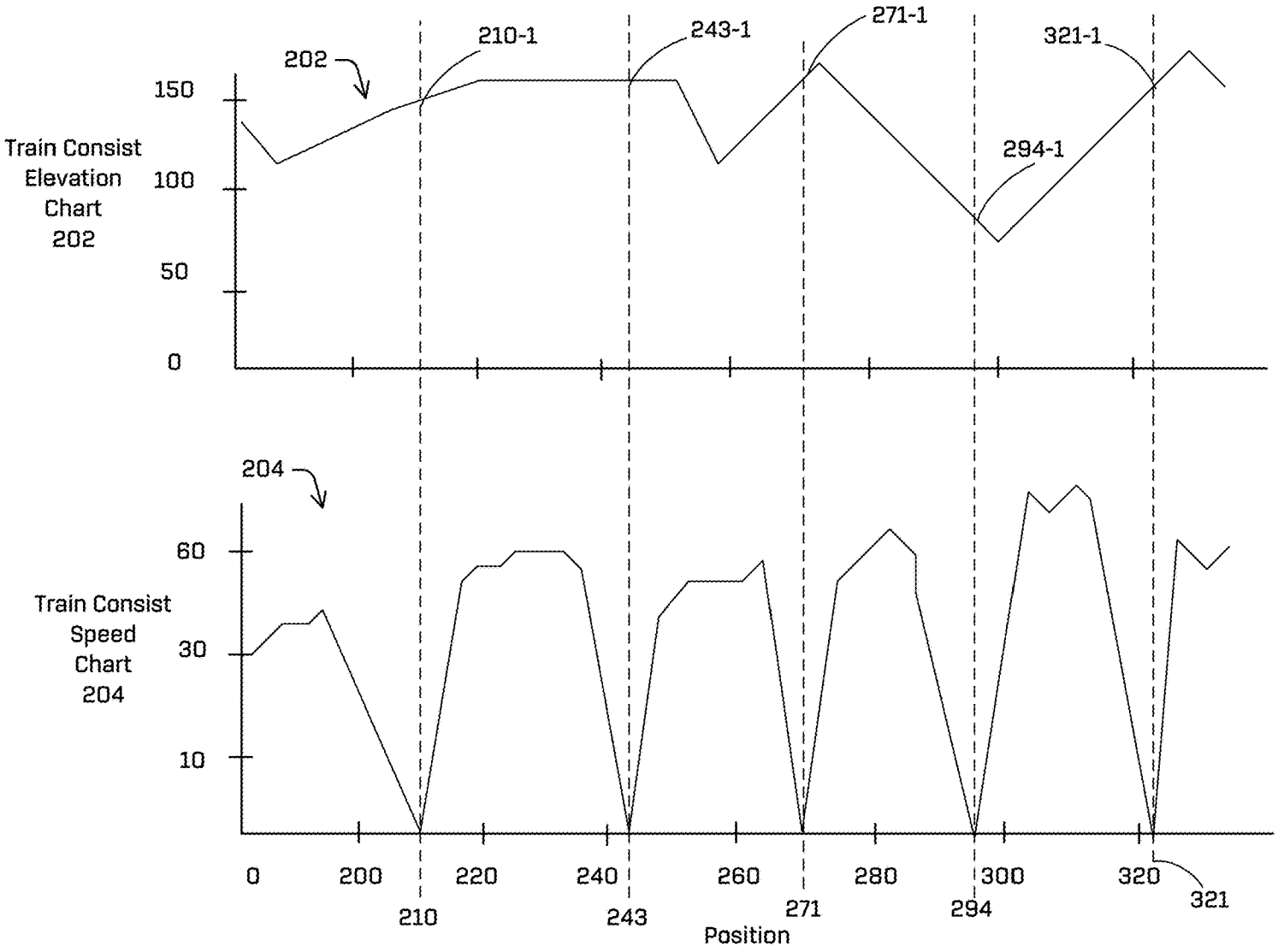
FIG. 2 illustrates a pair of charts showing route terrain elevations corresponding to stop and slowdown locations along an example train consist route, according to examples of the present disclosure.

FIGS. 2 and 3 illustrate data for an example train consist operation that may be utilized for understanding the impact of speed changes (e.g., stops, starts, slowdowns, speed ups, braking and meets and passes) encountered or required by the example train consist over the course of a planned route. FIG. 2 illustrates a pair of charts 202, 204 showing terrain elevation changes for an example train consist route (chart 202) corresponding to stop and/or slowdown locations along the example train consist route (chart 204), according to examples of the present disclosure. For purposes of illustration, chart 204 shows different stop locations 210, 243, 271, 294, and 321 of an example train consist operating in the same direction as one or more other train consists over a given operating territory. According to examples, stop and/or slow down locations may be chosen based on a number of factors including the ability of the train to fit into a siding track 108, 110 locations that do not block railroad crossings 134, and locations where the train will be able to easily restart or speed up again. The stop locations in the chart 204 are identified by locations where the speed of the example train consist approaches or reaches a stop speed of zero (0) miles per hour (mph).

Referring still to FIG. 2, chart 202 illustrates elevation changes encountered by a given train consist in association with speed changes illustrated in chart 204. For example, elevation location 210-1 in chart 202 corresponds with stop location 210 in chart 204. Elevation location 243-1 in chart 202 corresponds with stop location 243 in chart 204. Elevation location 271-1 in chart 202 corresponds with stop location 271 in chart 204. Elevation location 294-1 in chart 202 corresponds with stop location 294 in chart 204. Elevation location 321-1 in chart 202 corresponds with stop location 321 in chart 204. Referring to FIGS. 2 and 3 together, it can be seen that the energy impact associated with accelerating the example train consist after stop location 210 is 0.87% (see FIG. 3) owing to a relatively level elevation change at stop location 210 (see FIG. 2). On the other hand, energy impact associated with accelerating the example train consist after stop location 294 is 1.30% (see FIG. 3) owing to an initial steep track decline, followed by a steep track incline at elevation location 294-1 (see FIG. 2). Similarly, at stop location 321, the energy impact associated with accelerating the example train consist after stop location 321 is 1.96% (see FIG. 3) owing to a steep track incline after stop 321 (see FIG. 2). As should be appreciated, the data represented in FIGS. 2 and 3 is for purposes of example only and is not limiting of vast amounts of data that may be generated for large numbers of operating train consists.

To analyze the impact of a given stop or slow down location on the overall energy consumption of a locomotive moving the example train consist, time in a locomotive throttling notch may be calculated for each train consist run at each stop or slow down location a prescribed distance (e.g., 2.5 miles) before and after the stop or slow down location. According to one example, the energy consumed (e.g., gallons of fuel or Ampere-hour or Watt-hour of electrical charge) may be compared to the overall energy consumed for an entire train consist route and averaged to arrive at an energy impact for the stop or slow down location. That is, for a given stop or slow down location, the energy impact, as illustrated and described below with reference to FIG. 3, is determined as a ratio of the determined energy consumption for the stop or slow down location to the total energy consumption for the entire train consist route without the stop or slow down location.

FIG. 3 illustrates a table 300 showing average gallons of fuel consumed for each stop, illustrated in FIG. 2. Measuring the fuel consumption a prescribed distance (e.g., 2.5 miles) before and after a train consist stops allows a determination of the energy consumption impact caused by a single stop. For example, as illustrated in the table 300, at stop location 210, the average gallons of fuel required to stop and restart is 62 gallons while the average gallons of fuel required without the stop is 41 gallons resulting in a stop impact for stop location 210 of 0.87%. At stop location 321, the average gallons of fuel required to stop and restart is 72 gallons while the average gallons of fuel required without the stop is 26 gallons resulting in an energy consumption impact for stop location 321 of 1.96%. Thus, from such data, it can be seen that the location of a given stop (for example, a stop on an incline) can have a dramatic impact on energy consumption.

According to examples of the present disclosure, when an operating plan for a given train consist or network of train consists is developed, stops such as stop 321 are relocated when possible. For example, if stop 321 is on an incline and can be relocated to a more level track location by adjusting movement of the example train consist relative to other train consists, then the change is made prior to executing the operating plan for the example train consist, as described below with reference to FIGS. 4 and 6. As should be appreciated, the data illustrated and described with reference to FIGS. 2 and 3 is for purposes of example only and is not limiting of similar or different data that may be associated with a vast number of other train consists operations. For example, while table 300 in FIG. 3 shows fuel consumption analysis for stops, a similar analysis and tabulation of data may be performed for electrical charge consumption for stops as may be the case for an electric or hybrid locomotive or for fuel or electrical consumption for slowdowns and braking locations.

According to examples, energy consumption data in association with stops, slowdowns and route terrain, as illustrated in FIGS. 2 and 3, may be provided to or accessed by the driving strategy engine 422, described in detail below, to allow operating plans for one or more future train consists to be developed with consideration of energy consumption impact of stopping and/or slow down locations. In addition, energy consumption data, as illustrated in FIGS. 2 and 3, may be fed into the train pacing model, described in detail below, to allow operating plans for one or more future train consists to be developed with consideration of energy consumption impact of stopping and/or slow down locations. That is, by knowing energy consumption levels caused by operating in various conditions requiring various speed changes (e.g., stops, starts, slowdowns, speed ups, braking) associated with good energy consumption can be utilized in future planning, and conditions associated with excessive energy consumption can be avoided. For example, if it is known that stopping a train consist at a meet and pass location with another train consist will require excessive fuel and/or electrical charge consumption to re-start train consist after the meet and pass, then the location of the meet pass may be changed to a location where less energy consumption will be required for restarting a stopped train consist or speeding up a slowed train consist.

Figure 4:
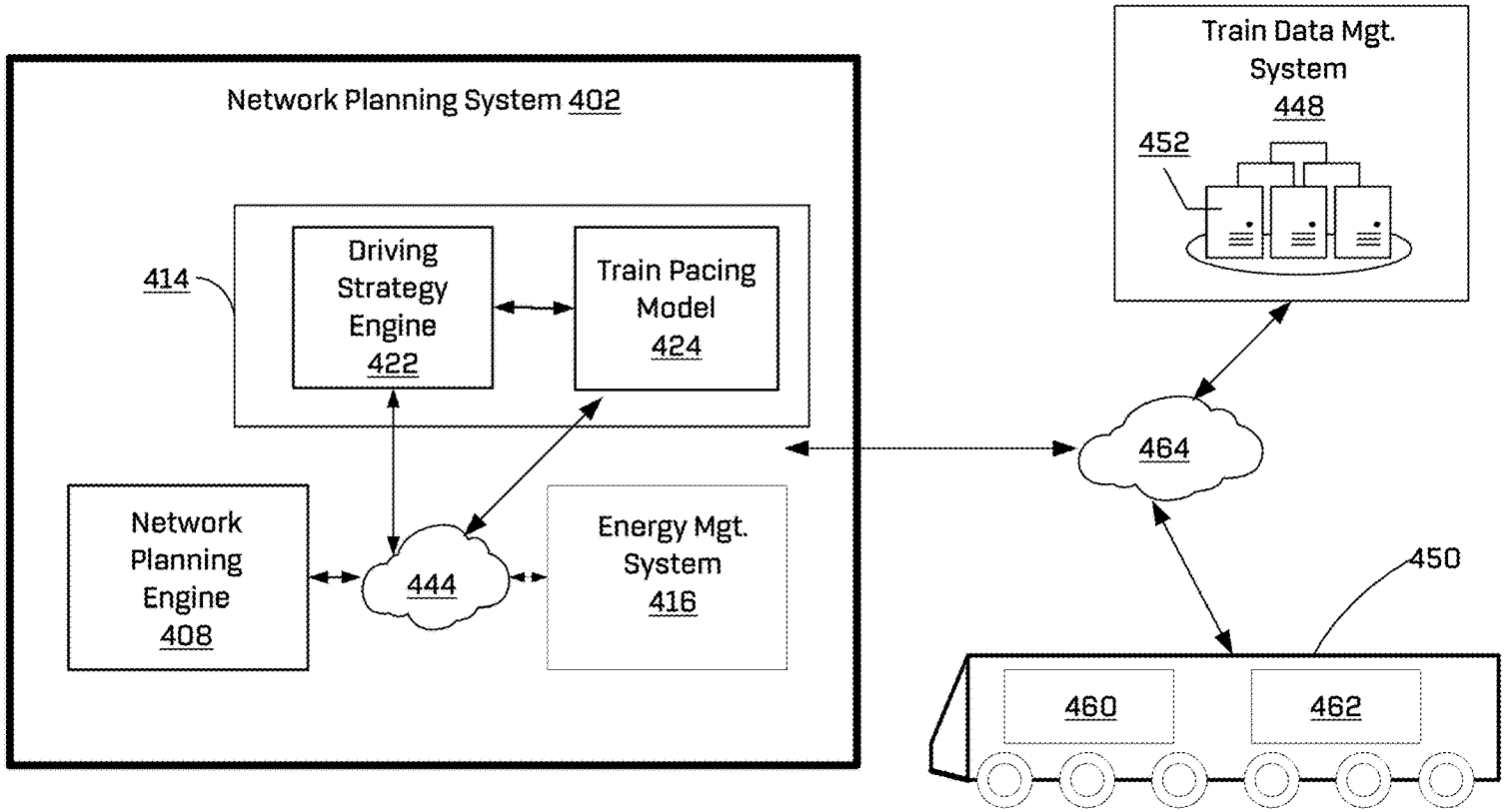
FIG. 4 illustrates a system architecture for pacing movement of one or more train consists to improve energy consumption, according to examples of the present disclosure.

FIG. 4 illustrates a system architecture for pacing movement of one or more train consists to improve energy consumption, according to examples of the present disclosure. The system 400 includes a network planning system 402 that is operative to simulate and execute operating plans for an individual train consist or a network of train consists. Referring still to FIG. 4, according to examples, the network planning system 402 includes a network planning engine 408, a train pacing system 414 (including a driving strategy engine 422 and a train pacing model 424), and an energy management system 416.

According to examples, the network planning engine 408 may include a processor and associated memory (as illustrated and described with reference to FIG. 7) and sufficient computer-executable instructions for simulating and executing an operating plan for an individual train consist or for a network of train consists. As described herein, energy consumption data (i.e., fuel and/or electrical charge data) associated with operating one or more train consists is monitored, analyzed and stored, as illustrated above with reference to FIGS. 2 and 3. In particular, energy consumption data associated with stops, starts, slowdowns, speed ups, braking, and meets and passes encountered by one or more train consists are monitored, analyzed and stored. For subsequent planning for a given train consist or network of train consists, the network planning engine iteratively simulates operation of a desired train consist or network of train consists to arrive at an operating plan that considers locations of starts, stops, slow downs, speed ups, braking, and meets and passes to optimize energy consumption for the desired train consist or network of train consists. For example, referring back to FIGS. 2 and 3, if it is known that starting a stopped train consist or speeding a slow train consist at a particular location requires excessive energy consumption (e.g., where the particular location is on a track incline), the network planning engine 408 may generate a simulated operating plan for the desired train consist that avoids stopping or slowing down movement of the train consist at that particular location. Similarly, if braking the desired train consist at a particular location results in excessive energy consumption (e.g., where at the particular location is on a track decline), the network planning engine 408 may generate a simulated operating plan that avoids braking at that particular location.

According to examples, the network planning engine may access data associated with different speed changes (e.g., stopping, starting, slowing down, speeding up, braking, and meets and passes) for iteratively simulating an operating plan for the desired train consist. For example, by analyzing and storing energy consumption data of a vast number of train consist operations over routes having various stops, starts, slowdowns, speed ups, braking and meets and passes locations, the network planning engine 408 may iteratively simulate operating plans for a desired train consist until a particular simulated plan is generated that optimizes energy management by selecting locations of starts, stops, slowdowns, speed ups, braking, and meets and passes that results in a best overall energy consumption for the desired train consist or network of train consists over a planned over planned routes. Alternatively, as described below, the network planning engine may obtain energy consumption data associated with different speed changes and use the obtained energy consumption data to develop an optimized operating plan for one or more planned train consists without iteration. Such an initial operating plan may be executed and modified "on the fly" as energy consumption data is received from locomotives operating by the initial operating plan for one or more train consists that are in operation (i.e., currently moving) along a planned route.

In the case of a network of train consists, as illustrated and described with reference to FIG. 1, the network planning engine 408 may simulate operating plans for each of a plurality of train consists comprising the network of train consists. For example, by knowing energy consumption associated with a number of previously operated train consists in a network of train consists, as illustrated in FIG. 1, the network planning engine 408 may simulate operating plans for the network of train consists that optimizes the energy management by selecting locations of stops, starts, slowdowns, speed ups, braking, and meet some passes of each train consist in the network of train consists relative to other train consists in the network of train consists that results in a best overall energy consumption for the network of train consists.

Referring still to FIG. 4, the driving strategy engine 422 may include a processor and associated memory (as illustrated and described with reference to FIG. 7) and sufficient computer-executable instructions for determining how a given train consist or network of train consists will perform over a planned route. According to examples, the driving strategy engine 422 may receive energy consumption information for train consists from the energy management system 416, described below, and/or from the onboard energy management system 462, described below. For each train consist for which energy consumption data is available, the driving strategy engine may determine and tabulate average energy consumption data associated with various stop or slow down locations, as illustrated and described above with reference to FIG. 3. In addition, the driving strategy engine 422 may associate energy consumption data for each train consist with operational information for each train consist, including but not limited to, train consist makeup (i.e., numbers and positions of railway cars and locomotives) locomotive power, track data (e.g., elevation changes, distance, etc.), speed limits along the planned route, and locations along a planned route at which the given train consist or plurality of train consists stop stops, starts, slows down, speeds up, breaks, or meets and passes other train consists. According to examples, the network planning engine 408 may query the driving strategy engine 422 for energy consumption data showing the impact of stop and/or slow down locations on energy consumption to assist the network planning engine 408 in building an operating plan for one or more train consists including the selection of stops and/or slow down locations that provide efficient energy consumption.

Referring still to FIG. 4, a train pacing model 424 may be utilized for modeling energy consumption information for planned train consists for determining how a given train consist or network of train consists will perform over a planned route. According to examples, the train pacing model 424 may include an artificial intelligence (AI) model that uses deep learning algorithms, neural networks and natural language processing to emulate human behavior by learning from a large quantity of information and by providing responses to queries by finding or synthesizing a response to a query by comparing elements of a received query with vast amounts of information taught to the AI model. The AI model may employ machine learning techniques to learn insights about data and to recognize patterns (i.e., including statistical relationships) between and among data points, text items and represented objects) to assist the AI model to return a response. For example, a query to the train pacing model for energy consumption information for a planned train consist may use machine learning techniques, to parse data (e.g., as illustrated in FIG. 3) and to use elements of the received query to locate and/or synthesize a response from the information or data either available to the AI model, or synthesized from data with which the AI model has been trained.

According to examples, the train pacing model 424 may be trained with energy consumption information associated with a vast number of different train consists having different makeups and operating according to different route conditions and different speed limits, starts, stops, slowdowns, speed ups, braking, and meets and passes. As should be appreciated, the train pacing model may be trained with information for hundreds, thousands or more of different train consists. Information for each train consist or network of train consist that completes a route may be fed into the train pacing model so that it is continually trained with additional information. In addition, energy consumption may be passed to the train pacing model 424 "on the fly" while a train consist is enroute along its planned route. In addition to the vast amounts of data fed into the train pacing model, relationships (e.g., statistical relationships) between words, phrases, or data may be taught to the train pacing model to teach it how to respond to queries via the machine learning techniques. Thus, when a query from the network planning engine 408 is passed to the train pacing model 424, the query information may be used by the train pacing model 424 to return energy consumption information associated with speed changes identified in the query to assist the network planning engine 408 in simulating an operating plan for one or more planned train consists.

The driving strategy engine 422 and the train pacing model 424 may operate separately where each may receive queries from the network planning engine 408 for energy consumption information associated with speed changes that will be encountered by one or more train consists either for planned stops such as loading/unloading stops and for stops or slowdowns required for deconflicting travel of one or more train consists relative to one or more other train consists. That is, the driving strategy engine 422 may return responsive information by using information contained in a query from the network planning engine to locate responsive energy consumption data, for example, from a database of energy consumption data as illustrated in FIG. 3. Alternatively, the network planning engine may query the train pacing model for energy consumption data responsive to a query, and the train pacing model may utilize machine learning techniques for finding or synthesizing data responsive to the query. According to an alternative example, the driving strategy engine and the train pacing model may work in concert where a query to the driving strategy engine may be passed to the train pacing model for a response that is, in turn, used by the driving strategy engine 422 to generate a response to the query from the network planning engine.

For example, a query from the network planning engine 408 may be passed to the driving strategy engine 422 or to the train pacing model or to both by passing the query to the driving strategy engine that, in turn, utilizes the train pacing model for generating a response. The query may include a planned train consist makeup (i.e., numbers and positions of railway cars and locomotives) locomotive power, track data (e.g., elevation changes, distance, etc.), speed limits along the planned route, as well as planned stops, starts, slowdowns, speed ups, braking, and meets and passes. The driving strategy engine 422 may parse a database, for example, as illustrated in FIG. 3, for energy consumption data responsive to the query, including energy consumption impact data associated with identified speed changes locations (e.g., locations of stops and/or slowdowns followed by starts and speed ups). That is, information from the driving strategy engine 422 may inform the network planning engine 408 as to how the planned train consist or network of train consists will perform from and energy consumption perspective given planned train consist operational information and speed changes locations provided in the query to the driving strategy engine.

Alternatively, the network planning engine 408 may pass a query to the train pacing model 424 directly or through the driving strategy engine 422. In response to the query, the train pacing model 424 may use information contained in the query to find energy consumption data matching planned speed changes. According to examples, the train pacing model may be enabled, using machine learning techniques to return energy consumption data either from a database of energy consumption data, as illustrated in FIG. 3, or the train pacing model may synthesize energy consumption data responsive to the query. According to one example, the train pacing model may synthesize an operating plan for one or more train consists that includes recommending locations of speed changes along the routes of one or more train consists for which operating plans are being simulated by the network planning engine. That is, if the query from the network planning engine 408 to the train pacing model 424 includes planned routes and schedules for the one or more train consists for which operating plans are being simulated, the train pacing model may return recommended speed changes locations associated with optimum energy consumption for each of the one or more train consists based on the learnings of the train pacing model.

At the network planning engine 408, the returned energy consumption and energy consumption impact data for the planned train consist or network of train consists may be incorporated into an operating plan being simulated by the network planning engine 408. Based on the energy consumption information received from the driving strategy engine 422 or from the train pacing model 424, the network planning engine may simulate optimized speed changes locations for the planned train consist or network of train consists. If the energy consumption information for the simulated plan does not meet energy management requirements programmed into the network planning engine 408 (e.g., programmed by an operator of the train consist or network of train consists), then the network planning engine 408 may query the driving strategy engine 422 again.

According to examples, a prescribed energy impact ceiling may be set for a given stop or slow down location or for an overall planned train consist route completion. For example, a given railway operator may prescribe that if any stop of slow down location (see FIGS. 2 and 3) is associated with an energy impact above 1.0%, then the network planning engine should attempt to move the stop or slow down to a location associated with a lower energy impact. Alternatively, the given railway operator may prescribe that if an overall energy impact for a planned train consist route exceeds 1.0%, then modification of the operating plan (including stop and slow down locations) for the example train consist should be changed to lower the overall energy impact of stops and/or slowdowns. For example, if one or more stops along a train consist route are associated with energy impacts above a prescribed level, but those stops or slowdowns may not be moved (e.g., a stop at an unloading location), then changes to other stop or slow down locations may be made to decrease the overall energy impact for the planned train consist route.

Thus, the network planning engine 408 may iteratively simulate operation of a train consist or network of train consists until the resulting simulated operation is optimized for energy management efficiency. Alternatively, the network planning engine may obtain energy consumption data associated with different speed changes and use the obtained energy consumption data to develop an initial optimized operating plan for one or more planned train consists without iteration. Such an initial operating plan may be executed and modified "on the fly" as energy consumption data is received from locomotives operating by the initial operating plan for one or more train consists that are in operation (i.e., currently moving) along a planned route.

For example, if a query to the driving strategy engine 422 or train pacing model 424 for a given train consist simulation returns energy consumption data as illustrated in FIG. 3, the network planning engine 408 may determine that stop locations 271, 294 and 321 will require excessive energy consumption to restart or speed up the stopped or slowed train consist. In response to the returned information showing a relatively significant energy consumption impact associated with these three stops, the network planning engine 408 may iterate back to the driving strategy engine 422 or train pacing model 424 with a new query providing changes to the planned stop locations 271, 294 and 321 where the network planning engine may compare the information for the given train consist with information for other train consists that will operate in the same territory according to overlapping schedules. Thus, given the locations and schedules of other train consists, the network planning engine 408 may locate other stop locations relative to other train consists that may be substituted for the initial planned stop locations 271, 294 and 321.

The network planning engine 408 may pass the modified stops information back to the train pacing system 414 (e.g., driving strategy engine 422 and/or train pacing model 4240 to obtain energy consumption impact data for the new stops. Once the network planning model simulates a plan for the one or more train consists that meet energy consumption requirements, a final version of the simulated plan may be passed to locomotives of the one or more train consists to direct their operation based on the simulated plan. Alternatively, the train pacing model may be employed to respond to the initial query from the network planning model with stops or slowdowns locations that will optimize an operating plan for the one or more train consists without the need to iterate as described above.

Referring still to FIG. 4, the energy management system 416 may include a processor and associated locomotive memory (as illustrated and described with reference to FIG. 7) and sufficient computer-executable instructions for receiving, storing and analyzing energy management information for one or more train consists. According to examples of the present disclosure, the energy management system may provide energy management information to the driving strategy engine 422, the train pacing model 424, and the network planning engine 408 for enabling each of these systems to analyze and utilize energy management information such as energy consumption information, as described herein. Energy management information that may be received, stored and analyzed may include but is not limited to operational information such as locomotive horsepower ratings, locomotive horsepower-per-ton ratings, locomotive towing capacity ratings, fuel or electrical charge usage information for locomotives, as well as, onboard engine performance data such as fuel and/or electrical charge levels and consumption rates, battery capacity, engine temperatures, engine RPMs at varying operating conditions, fluid levels and pressures, and the like. According to examples, in addition to energy consumption data processing by the driving strategy engine 422 and the train pacing model 424, energy consumption data analyzed and stored, as illustrated in FIGS. 2 and 3, may also be analyzed and stored at the energy management system 416, and such data may be retrieved from the energy management system 416 by the driving strategy engine 422, the train pacing model 424, and the network planning engine 408 for simulating and executing operating plans for one or more train consists.

In FIG. 4, the network planning engine 408, train pacing system 414 (i.e., the driving strategy engine 422 and the trained pacing model 424), and the energy management system 416 are illustrated as separate systems. However, each of these systems or combinations thereof may be integrated together. For example, as described above, the train pacing model 424 may be integrated with the driving strategy engine 422 so that queries made to the driving strategy engine 422 may be passed to the train pacing model 424 for query processing, as described above. According to another example, the network planning engine 408 may be integrated with the driving strategy engine 422 and the train pacing model 424 and communicatively associated with the energy management system 416 via the network 444. Alternatively, all these systems may operate via a single computing system 700, as illustrated and described below.

Referring still to FIG. 4, the locomotive 450 is illustrative of a locomotive that may be used for moving one or more train consists according to examples of the present disclosure. The locomotive 450 may represent combustion locomotives (e.g., diesel), electric locomotives, hybrid (fuel/electric) locomotives, gas turbine engine locomotives, and the like. The locomotive 450 may include an onboard locomotive management system 460. According to examples, the locomotive management system 460 may include a processor and associated memory (as illustrated and described with reference to FIG. 7) and sufficient computer-executable instructions coupled with hardware systems of the locomotive 450 for assisting in the operation of the locomotive 450. The locomotive management system 460 may leverage artificial intelligence and machine learning models to encode locomotive engineer behavior, analyze train consist runs, and optimize train consist operation. For example, the locomotive management system 460 may record and store train engineer interactions with the locomotive 450 such as throttling and braking in association with train consist makeup (e.g., numbers and positions of railway cars on locomotives) with varying route conditions including terrain elevation, starts, stops, slowdowns, speed ups, braking, and meets and passes.

The train engineer interactions may be fed into an artificial intelligence model integrated with the locomotive management system 460. With each feeding of information into the artificial intelligence model or system, such model may learn more and more about operation of the associated locomotive 450 and other components of the train consist to which the locomotive is connected. In operation, the locomotive management system 460 utilizes the information recorded, stored and fed into the integrated artificial intelligence model to automate operation of the locomotive 450 including throttling, braking, stopping and starting based on its learned behavior of how locomotive engineers perform such functions manually. According to examples of the present disclosure, the onboard locomotive management system 460 and associated artificial intelligence model may be used to effect speed changes determined for an associated train consist that are optimized for energy consumption management.

The locomotive 450 also may include an onboard energy management system 462 for passing operational information such as horsepower ratings, horsepower-per-ton ratings, towing capacity ratings, fuel or electrical charge usage information, weight, performance through curves, performance through grade variations and speed changes, as well as, onboard engine performance data such as fuel and/or electrical charge levels, battery capacity, engine temperatures, engine RPMs at varying operating conditions, fluid levels and pressures, and the like to the energy management system 416, the train pacing model 424, the driving strategy engine 422, the network planning engine 408, or the train data management system 448 via a local or distributed network 464. That is, either periodically, after completion of a train consist run, or continuously, data from the onboard locomotive management system 460 may be passed to the components of the network planning system 402.

According to examples, information received from the locomotive 450 at the network planning system 402 may be used to provide updates to the driving strategy engine 422 and/or the train pacing model 424. According to examples, when the network planning engine 408 simulates individual or individual train consist plans or a network of train consist plans, as described above, the simulated plans may be passed back to the locomotive management system 460 of each locomotive comprising a given simulated plan. Each locomotive may then execute the received train consists plan and operation of the locomotives including automated operation may be executed. According to examples, execution of the received train consist plans from the network planning engine 408 includes executing stops, starts, slowdowns, speed ups, braking, and meets and passes to enable optimized energy management for each train consist or network of train consists. As should be appreciated, the onboard energy management system 462 of the locomotive 450 may receive operational data for the locomotive via one or more sensors (e.g., weight sensors, speed sensors, engine performance sensors, etc.) integrated with the locomotive.

Referring still to FIG. 4, the train data management system 448 is illustrative of a data repository in which information about train consists and/or individual components of a train consist such as locomotives, railway cars, as well as rail systems, such as track systems, switching systems, and the like may be stored. According to examples, the train data management system 448 may be operated for a single railway carrier at which data for its railway cars, locomotives and rail systems may be stored, or the train data management system 448 may be a central data repository where data from numerous railway carriers may be stored. As illustrated in FIG. 4, the train data management system 448 may employ one or more train data management system computing systems 452 for receiving, storing, processing, and distributing data. The train data management system 448 may operate remotely from the network planning system 402 and may communicate with the network planning system through a local or distributed network 464. For example, the network planning system 402 may require data for a train consist and/or a given locomotive 450. Information from the network planning system 402 and/or from the onboard locomotive management system 460 may be stored at the train data management system 448 via a network 464. According to examples, the network planning system 402 may query the train data management system 448 with an identification number, code or other identifier for a given train consist 112-124 (including individual railway cars comprising the various train consists) or locomotive 450 to receive data such as scheduling and destination information or physical information such as weight, cargo being carried, and energy management data for locomotives.

Figure 5:
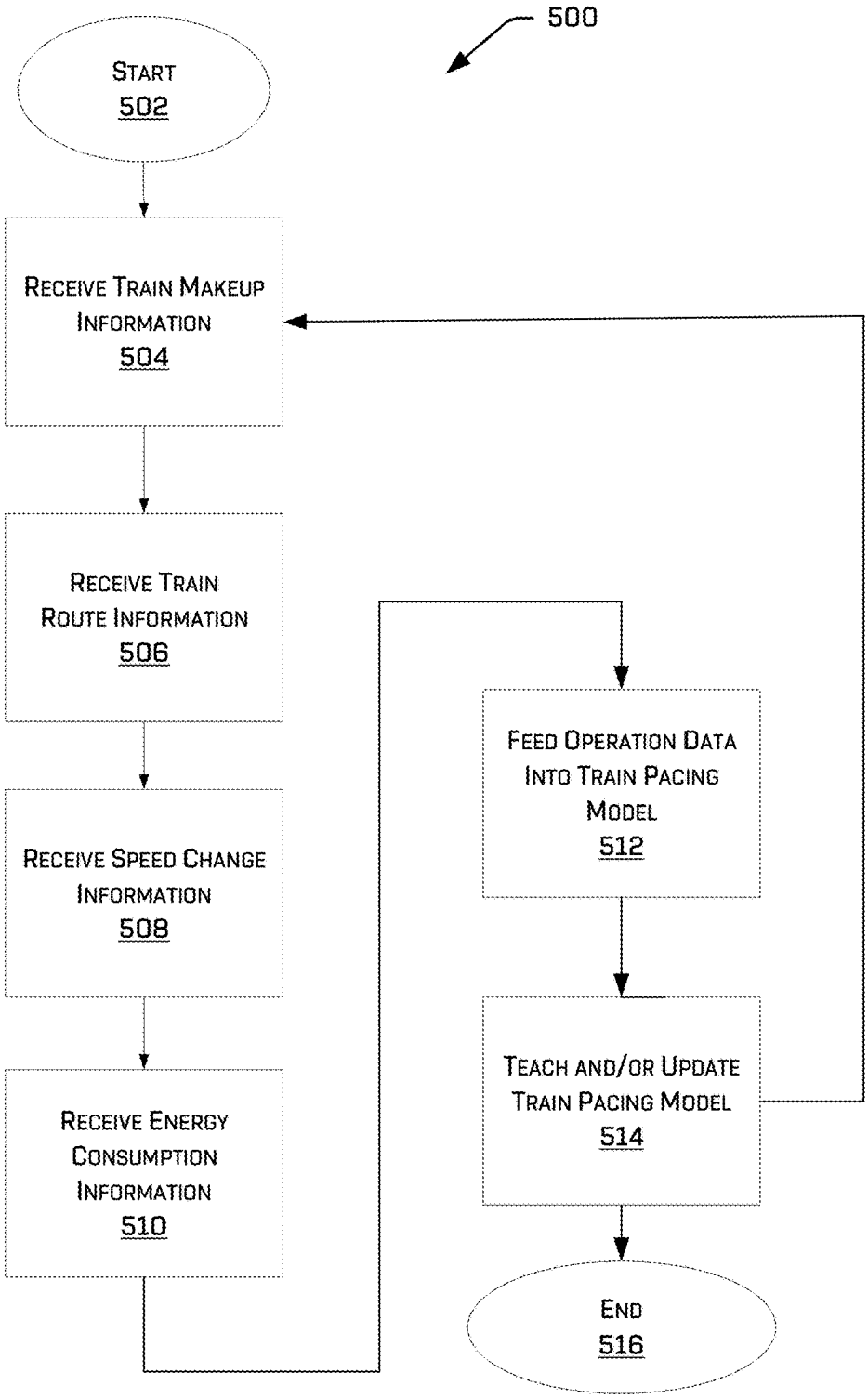
FIG. 5 illustrates a flow diagram of an example method for training and updating a train pacing model, according to examples of the present disclosure.

FIG. 5 illustrates a method 500 for training the train pacing model 424. As described herein, the network planning engine 408 of the network planning system 402 incorporates energy impact information associated with train consist stops, starts, slowdowns, speed ups, braking and meet and passes received from a driving strategy engine 422 and/or from a train pacing model 424. The driving strategy engine 422 may access the energy consumption information from the energy management system 416 that is populated with data from onboard locomotive management systems 460 from a large number of train consists. Alternatively, the trained pacing model may be trained with energy consumption information received from the energy management system 416 or from the onboard locomotive management systems 460 from a large number of train consists. After training, the train pacing model 424 may find or synthesize energy consumption information responsive to a query from the network planning engine 408.

The method 500 begins at start step 502 and proceeds to step 504 where train consist makeup information for a completed or in-process train consist plan is received at the train pacing model 424. As described above, train consist makeup information may be passed to the train pacing model from a locomotive 450 of a completed train consist run or from an in-process train consist run, or the train consist makeup information may be received from the energy management system 416, or from the train data management system 448.

At step 506, the train pacing model 424 receives train route information including distance, elevation changes and planned stops and slowdowns for the completed or in-process train consist. At step 508, speed changes information (i.e., for stops, starts, slowdowns, speed ups, braking, and meets and passes) for the completed or in-process train consist is received by the train pacing model 424 from the onboard locomotive management system 460 of the locomotive 450.

At step 510, energy consumption information including generated energy impact information computed for locations associated with speed changes encountered by the completed or in-process train consist (see FIGS. 2 and 3) is received at the train pacing model 424. Alternatively, energy consumption information may be passed from the locomotive 450 to the energy management system 416 of the network planning system 402, and the train pacing model 424 may receive the energy consumption information from the energy management system 416.

At step 512, the received train consist makeup information, train consist route information, train consist speed changes information, and the energy consumption information is fed into the train pacing model 424. At step 514, the training of the train pacing model 424 is updated to further refine the ability of the train pacing model 424 to find or synthesize energy consumption information associated with train consist speed changes based on a train consist query passed to the train pacing model 424 from the network planning engine 408, as described above.

After step 514, the method 500 proceeds back to step 504 where the train pacing model 424 receives train consist makeup information, route, speed changes and associated energy consumption data for a next train consist for further updating the training of the train pacing model 424. Thus, the train pacing model 424 continues to update its model learning with each successive input of train consist information so that the ability of the train pacing model 424 to respond to queries from the network planning engine 408 continues to improve. The method ends at step 516.

Figure 6:
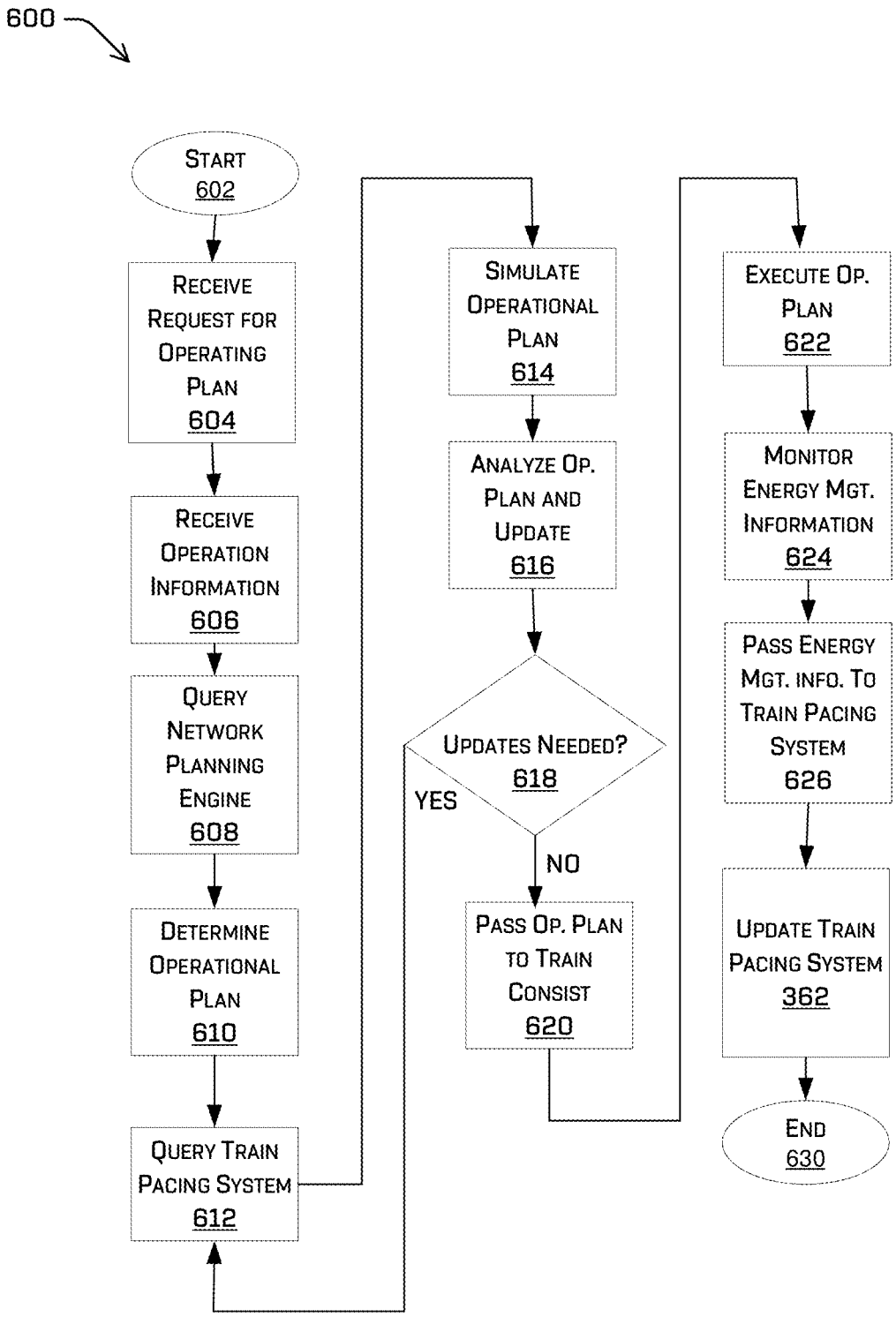
FIG. 6 illustrates a flow diagram of an example method for simulating and executing an operating plan for one or more train consists comprising a network of train consists, according to examples of the present disclosure.

FIG. 6 illustrates a method 600 for simulating and executing an operating network plan for an individual train consist or network of train consists, according to examples of the present disclosure. The method 600 begins at start step 602 and proceeds to step 604 where the network planning system 402 receives a request for simulation and execution of an operating plan for one or more train consists as part of a network plan. According to examples, the request for an operating plan may come from a variety of sources, for example, from personnel at a railyard at which one or more train consists are built or from a railway operator, such as a rail company.

At step 606, the network planning system 402 receives operational data for an individual train consist or for a network of train consists. Operational data may include planned train consist makeup (e.g., numbers and locations of railway cars and locomotives), route information (including distance, terrain elevation, planned stops, slowdowns, meets and passes, etc.), locomotive power information and speed limits along the planned route. The operational data may be received from a requesting party for the individual train consist or plurality of train consists comprising a network of train consists.

At step 608, the network planning engine 408 is queried for a simulation of operating plans for the requested one or more train consists. At step 610, the network planning engine 408 may determine an initial operating plan for the one or more train consists. The initial operating plan determination may include the number and positions of railway cars and locomotives and may account for planned stops, slowdowns, braking, and meets and passes relative to known schedules of other train consists that will operate on the same tracks or same territory according to similar schedules as the requested one or more train consists for which operating plan is requested.

At step 612, the network planning engine 408 may query the train pacing system 414 (i.e., the driving strategy engine 422 and/or the train pacing model 424) with the initial operating plan determination to obtain energy consumption information, including energy consumption impact for each of one or more stops or slowdowns along a planned route for the initial operating plan. As described above, the driving strategy engine 422 may return energy consumption information including energy impact information for planned stops and/or slowdowns it receives from the energy management system 416 or directly from the locomotive 450 of various completed or in-process train consists. That is, the train pacing system 414 may return determined energy consumption impact information for corresponding stops or slowdowns encountered by the train consist along the planned route. As described above, the energy consumption information returned by the driving strategy engine 422 may include energy impact information associated with planned stops or slowdowns (e.g., for unloading and/or loading) and for stops and/or slowdowns encountered owing to traffic of other train consists. As described above, the driving strategy engine may obtain the energy consumption information from a database of energy consumption information, as illustrated in FIG. 3. The database of energy consumption information may be maintained by the driving strategy engine 422 or at the energy management system 416, at the onboard energy management system 462, or at the train data management system 448. Alternatively, the driving strategy engine 424 may provide a query to the train pacing model 424 for energy consumption information, as described above.

According to another example, the network planning engine 408 may query the train pacing model 424 for energy consumption information. The network planning engine 408 may query the train pacing model with the same query as may be passed to the driving strategy engine 422, described above. The train pacing model may find or synthesize responsive data via machine learning techniques applied to the trained learnings of the train pacing model from input of energy consumption information from a large number of train consist operations.

As described herein, energy consumption information returned from the driving strategy engine 422 or train pacing model 424 may provide energy impact information associated with performance of a train consist or plurality of train consists before and after a stop, slow down, braking location or meet and pass location. For example, the initial determined operating plan with which the driving strategy engine or train pacing model are queried may provide a number of planned or anticipated stops, slowdowns, meet and pass locations. Based on the makeups of the planned one or more train consists, route information, schedule, and planned and/or anticipated stops, slowdowns, braking locations and/or meet and past locations, the driving strategy engine 422 or the train pacing model 424 may return energy impact information anticipated for the one or more train consists associated with braking the one or more train consist before a stop, slow down or meet and pass location and for accelerating the one or more train consists back to a desired operating speed after the stop, slow down or meet and pass location.

At step 614, the network planning engine 408 may simulate an updated operating plan for the one or more requested train consists based on the energy consumption information associated with planned or anticipated stops, slowdowns, meet and past locations. At step 616, the simulated updated operating plan is analyzed to determine whether the energy consumption information associated with the planned or anticipated stops, slowdowns and/or meet and pass locations results in inefficient energy impact for the one or more train consists. According to one example, this analysis determines whether any one or more of the planned stop or slow down locations is associated with an energy impact above a prescribed level, as described above. If analysis of the simulated updated operating plan shows excess energy consumption associated with one or more stops, slowdowns and/or meet and pass locations, the network planning engine 408 may determine whether the planned or anticipated stops, slowdowns and/or meet and pass locations may be moved to different locations where energy consumption needed to accelerate the one or more train consists back to desired operating speeds after the stop, slow down and/or meet and pass location is reduced resulting in improved overall train consist energy efficiency.

For example, if a particular stop location for a train consist is required to load or unload the train consist, then that stop location may not be moved. On the other hand, if a stop or slow down location of a particular meet and pass location may be moved by altering the operating speeds or other operating parameters of two of one or more train consists to allow the meet and pass location to occur at a track location (e.g., a level terrain location) associated with reduced energy consumption, then the network planning engine 408 may modify the simulated updated operating plan to allow the example meet and pass location to occur at a better location in terms of energy consumption.

As step 618, if updates to the simulated operating plan are needed, the method 600 returns back to step 612, and the network planning engine 408 again queries the train pacing system 414 (i.e., driving strategy engine or train pacing model) with a modified simulated operating plan that includes moving one or more of the planned or anticipated stops or slowdowns to different locations associated with more efficient energy consumption when a stopped or slowed train consist is accelerated back to a desired operating speed. According to examples, a modified operating plan for the train consist may include adjusting throttle settings and braking settings for one or more locomotives assigned to the train consist in addition to moving one or more of the planned or anticipated stops or slowdowns to different locations.

At step 612, the driving strategy engine 422 or the train pacing model 424 may return updated energy consumption information including modified energy impact information for stops and/or slowdowns for the modified simulated operating plan. The iterative process may continue until the network planning engine determines no additional updates are necessary at step 618. According to examples, if the network planning engine 408 queries the train pacing model 424 either directly or indirectly at step 612, the train pacing model may return a response that directs the network planning engine to modify the locations (where possible) of speed changes that provides a resulting operating plan for the one or more train consists that is energy efficient without the need for iteration by the network planning engine.

At step 618, if a final simulated operating plan is determined to be acceptable in terms of energy consumption, the method proceeds to step 620, and individual train consist operating plans for the one or more train consists comprising the requested network of train consist are passed to locomotives 450 of the one or more train consists. As should be understood, the train consist operating plans for each locomotive 450 for each train consist comprising the requested network of train consists will be individualized based on the makeup, route, schedule, etc. for each individual train consist. According to examples, the individualized train consist operating plans are sent to the locomotive management systems 460 of the locomotives 450.

At step 622, the individualized train consist operating plans received at the locomotive management systems 460 of each locomotive are executed. According to examples, the operating plans may automate operation of each locomotive 450 and associated train consist such that each train consist follows its planned route and such that locations of stops, starts, slowdowns, speed ups, braking and/or meets and passes are optimized for energy efficiency. Alternatively, if one or more train consists are operated manually by train engineer, then the executed operating plans may be used to recommend locomotive throttle settings and braking settings to the train engineer to arrive at the desired energy efficiency.

At step 624, energy management data, including energy consumption information, for each train consist is monitored, recorded, and stored at the onboard energy management system 462 of each locomotive 450 of each train consist. At operation 626, recorded energy management information, including stored energy consumption information, is passed to the energy management system 416 of the network planning system 402, or directly to the train pacing system 414 and/or to the train pacing model 424. According to examples, energy management information may also be passed to the train data management system 448 if desired. At operation 628, energy management information received at the train pacing model 424 may be used to update the train pacing model for subsequent use in synthesizing future train consist operating plans, as described herein. The method 600 ends at step 630.

Figure 7:
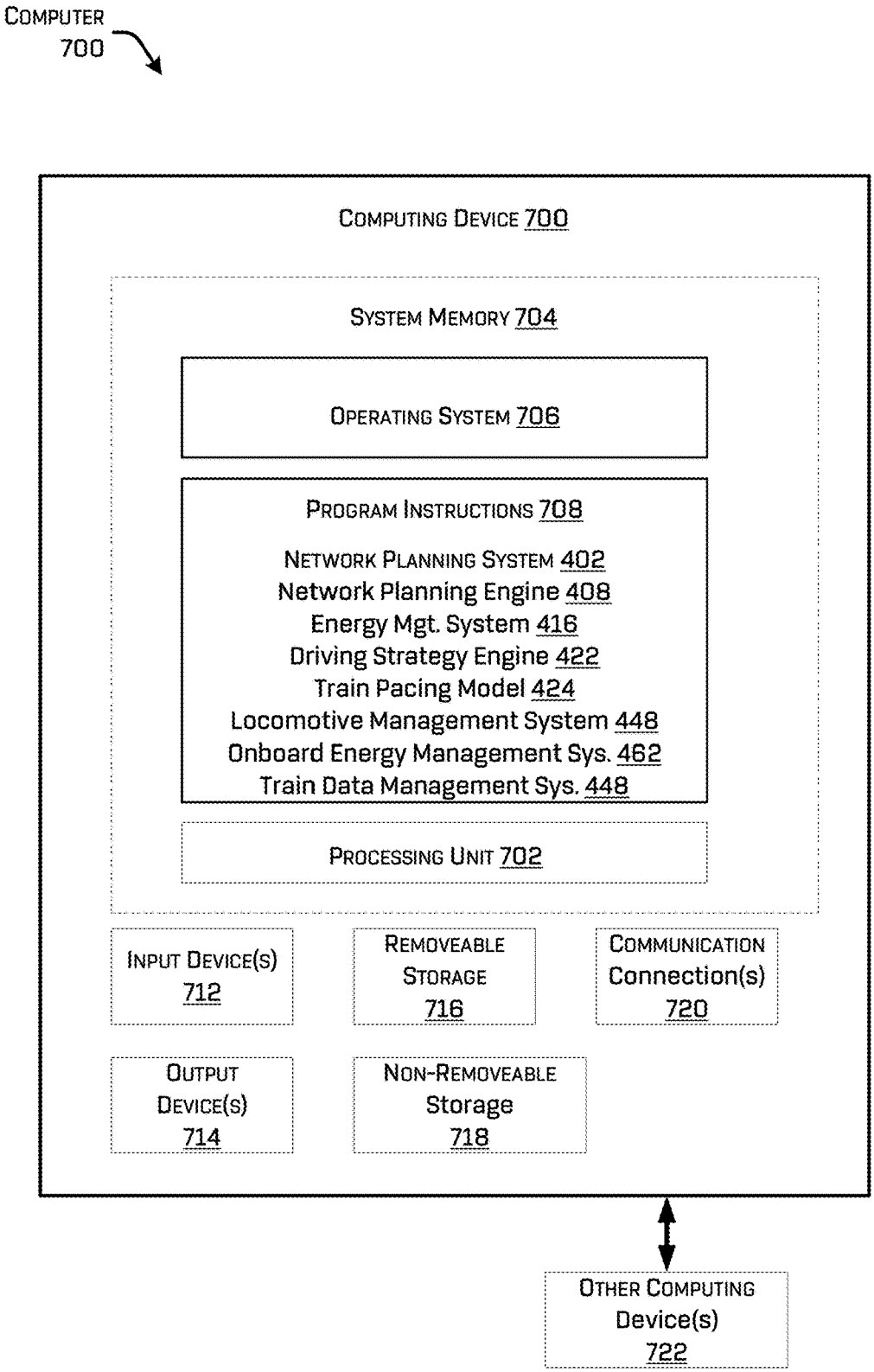
FIG. 7 is a computer architecture diagram showing an illustrative computer hardware architecture for implementing a computing system/device that can be utilized to implement aspects of the various technologies presented herein, according to examples of the present disclosure.

FIG. 7 is a block diagram illustrating physical components of an example computing device with which examples of the present disclosure may be practiced. The computing system 700 may include at least one processing unit 702 and the system memory 704. The system memory 704 may comprise, but is not limited to, volatile (e.g., random access memory (RAM)), non-volatile (e.g., read only memory (ROM)), flash memory, or any combination thereof. System memory 704 may include an operating system 706, one or more program instruction 708, and may include sufficient computer-executable instructions for operating the network planning system 402, the network planning engine 408, the energy management system 416, the driving strategy engine 422, the train pacing model 424, the train data management system computing systems 452, the locomotive management system 460 and the onboard energy management system 462, which when executed, perform functionalities as described herein. Operating system 706, for example, may be suitable for controlling the operation of the computing system 700. Furthermore, examples may be practiced in conjunction with a graphics library, other operating systems, or other application programs and is not limited to any application or system. This basic configuration is illustrated by those components within a dashed line 710. The computing system 700 may also include one or more input device(s) 712 (e.g., keyboard, mouse, pen, touch input device, etc.) and one or more output device(s) 714 (e.g., display, speakers, printers, etc.).

The computing system 700 may also include additional data storage devices (removable or non-removable) such as, for example, magnetic discs, optical discs, or tape. Such additional storage is illustrated by removable storage 716 and a nonremovable storage 718. The computing system 700 may also contain a communication connection 720 that may allow the computing system 700 to communicate with other computing devices 722, such as over a network in a distributed computing environment, for example, an intranet or the Internet. The communication connection 720 is an example of a communication medium, via which computer-readable transmission media (i.e., signals) may be propagated.

Program modules may include routines, programs, components, data structures, and other structures that may perform tasks or that may implement particular abstract data types. Moreover, examples may be practiced with other computer system configurations, including hand-held devices, multiprocessor systems, microprocessor-based or programmable user electronics, minicomputers, mainframe computers, and the like. Examples may also be practiced in distributed computing environments where tasks are performed by remote computing and processing devices that are linked through a communications network. In a distributed computing environment, programming modules may be located in both local and remote memory storage devices. Furthermore, examples may be practiced in an electrical circuit comprising discrete electronic elements, packaged or integrated electronic chips containing logic gates, a circuit using a microprocessor, or on a single chip containing electronic elements or microprocessors (e.g., a system-on-a-chip (SOC)). Examples may also be practiced using other technologies capable of performing logical operations such as, for example, AND, OR, and NOT, including but not limited to mechanical, optical, fluidic, and quantum technologies. In addition, examples may be practiced within a general-purpose computer or in other circuits or systems.

Examples may be implemented as a computer process (method), a computing system, or as an article of manufacture, such as a computer program product or computer-readable storage medium. The computer program product may be a computer storage medium readable by a computer system and encoding a computer program with instructions for executing a computer process. Accordingly, hardware or software (including firmware, resident software, microcode, etc.) may provide examples discussed herein. Examples may take the form of a computer program product on a computer-usable or computer-readable storage medium having computer-usable or computer-readable program code embodied in the medium for use by, or in connection with, an instruction execution system.

Examples of the present disclosure may be implemented via local and remote computing and data storage systems. Such memory storage and processing units may be implemented in a computing device. Any suitable combination of hardware, software, or firmware may be used to implement the memory storage and processing unit. For example, the memory storage and processing unit may be implemented within the computing system 700 or any other computing devices 722, in combination with the computing system 700, where functionality may be brought together over a network in a distributed computing environment, for example, an intranet or the Internet to perform the functions described herein. Systems, devices, and processors described herein are provided as examples; however, other systems, devices, and processors may comprise the memory storage and processing unit, consistent with the described disclosure.

Reference is made herein to the examples illustrated in the drawings, and specific language is used herein to describe the same. It will nevertheless be understood that no limitation of the scope of the technology is thereby intended. Alterations and further modifications of the features illustrated herein, and additional applications of the examples as illustrated herein, which would occur to one skilled in the relevant art and having possession of this disclosure, are to be considered within the scope of the description.

Furthermore, the described features, structures, or characteristics may be combined in any suitable manner in one or more examples. In the preceding description, numerous specific details have been provided, such as examples of various configurations to provide a thorough understanding of examples of the described technology. One skilled in the relevant art will recognize, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features, it is to be understood that the subject matter defined in the appended claims is not necessarily limited to the specific features described. Rather, the specific features are disclosed as illustrative forms of implementing the claims.

INDUSTRIAL APPLICABILITY

The present disclosure provides methods and systems for pacing movement of train consists to improve energy consumption. When train consists made up of a number of railway cars and one or more locomotives make planned stops (e.g., for loading, unloading and the like) and stops or slowdowns to avoid other train consists (e.g., oncoming train consists on the same track or train consists traveling in the same direction with overlapping schedules), accelerating the train consists from a stopped or slowed status back to a desired operating speed consumes varying amounts of energy depending on route terrain and other factors. Methods and systems of the present disclosure provide for simulation and execution of operating plans for one or more train consists that optimizes energy consumption associated with stops, slowdowns, restarts, speed ups, braking and meets and passes.

Energy consumption associated with previous or in-process train consist starts, stops, slowdowns, speed ups, braking and meets and passes is measured and stored. Energy consumption (e.g., fuel and/or electrical charge consumption) impact associated with various locations at which train consists stop or slow down is determined by a driving strategy engine or train pacing model. The driving strategy engine may calculate and store energy consumption impact information, for example, average gallons of fuel required to accelerate a train consist back to a desired operating speed after each stop or slow down along the route of the train consist. The driving strategy engine may provide energy consumption information from stored data or by querying the train pacing model. The train pacing model may utilize an artificial intelligence model that employs machine learning techniques to provide energy consumption impact information by finding or synthesizing energy consumption impact information from energy consumption information fed into the artificial intelligence model for training the model.

The energy consumption impact determinations may be used by a network planning engine to simulate operating plans for one or more train consists that optimize locations of stops or slowdowns so that subsequent acceleration back to desired operating speeds is performed in an energy-efficient manner. The network planning engine simulates operation of one or more train consists. The simulation accounts for makeup (e.g., numbers and positions of railway cars and locomotives) for each of the one or more train consists as well as operational information such as route conditions, including terrain elevations, planned or anticipated stops or slowdowns, track speed limits, and the like. Given that each of the one or more train consists will be required to stop or slow down from time-to-time for loading, unloading, crossing roads or other train tracks, and the like, and/or for avoiding contact with other train consists on the same or neighboring tracks, the network planning engine builds a simulated operating plan for the one or more train consists that optimizes locations of the stops or slowdowns so that subsequent acceleration back to desired operating speeds is optimized for energy consumption. For example, if a planned stop at a loading or unloading location must be made, then energy consumption impact for that stop or slow down location may have to be accepted. On the other hand, if a stop or slow down location to allow for a meet and pass with another train consist will occur at an undesirable location for energy consumption impact, for example, on a steep incline, then the network planning engine, based on energy consumption impact information for that stop of slow down location, may modify the operating plans for both train consists so that they meet and pass at another location associated with a better energy consumption impact (e.g., a location not on a steep incline).

After operating plans for each of the one or more train consists are simulated and modified (if required) to provide optimized energy consumption based on stop or slow down locations, the operating plans may be passed to onboard locomotive management systems for each locomotive. The operating plans may then be used to automate locomotive operation (e.g., throttling notch settings and braking) to operate each train consist according to the received operating plans. Alternatively, instead of automating locomotive operation, the received operating plans may be used to recommend operating parameters (e.g., throttling notch settings and braking) to train engineers. Energy consumption information for in-process train consists may be monitored, stored, and utilized for subsequent energy consumption impact determinations for use by the network planning engine for simulating and executing future train consist operating plans.

While aspects of the present disclosure have been particularly shown and described with reference to the embodiments above, it will be understood by those skilled in the art that various additional embodiments may be contemplated by the modification of the disclosed machines, systems, and methods without departing from the spirit and scope of what is disclosed. Such embodiments should be understood to fall within the scope of the present disclosure as determined based upon the claims and any equivalents thereof.

The invention claimed is:

1. A method of pacing movement of a train consist, comprising:

receiving a request for a train consist including one or more railway cars and one or more locomotives;

receiving one or more operating parameters for the requested train consist;

determining an operating plan for the requested train consist based on the one or more operating parameters, the operating plan including one or more stops along a route of the requested train consist;

querying a train pacing system for an energy consumption impact for each stop of the one or more stops along the route of the requested train consist;

based on the energy consumption impact for at least one stop of the one or more stops along a route of the requested train consist exceeding a prescribed energy consumption impact, modifying the operating plan to move a particular location of the at least one stop to a different stop location where an energy consumption impact for the different stop location does not exceed the prescribed energy consumption impact; and operating the requested train consist according to the modified operating plan.

2. The method of claim 1, wherein operating the requested train consist according to the modified operating plan includes:

determining energy consumption information for the requested train consist, and providing the consumption information to the train pacing system.

3. The method of claim 2, further comprising:

at the train pacing system:

receiving the energy consumption information; and determining, based on the received energy consumption information, an energy consumption impact of each stop encountered by the requested train consist along the route of the requested train consist.

4. The method of claim 3, further comprising:

storing the determined energy consumption impact of each stop for providing an energy consumption impact for one or more stops of a subsequent requested train consist.

5. The method of claim 4, further comprising:

in response to querying the train pacing system for an energy consumption impact for a given stop included in the subsequent requested train consist, returning the determined energy consumption impact of a corresponding stop to the given stop encountered by the requested train consist for use by the train pacing system.

6. The method of claim 3, wherein determining the energy consumption impact of each stop encountered by the requested train consist along the route of the requested train consist includes:

determining an energy consumption required for bringing the requested train consist to a stop at each stop of the one or more stops along the route of the requested train consist, and for accelerating the requested train consist to a desired operating speed after bringing the requested train consist to a stop; and determining the energy consumption impact as a ratio of the determined energy consumption to an overall energy consumption required for operating the requested train consist according to the modified operating plan without the stop for which the energy consumption is determined.

7. The method of claim 4, further comprising:

feeding the determined energy consumption impact of each stop encountered by the requested train consist into a train pacing model of the train pacing system;

updating a training of the train pacing model based on the determined energy consumption impact; and returning, by the train pacing model, an energy consumption impact for each stop of one or more stops along the route of the subsequent requested train consist.

8. The method of claim 1, wherein querying the train pacing system for the energy consumption impact for each stop of the one or more stops along the route of the requested train consist includes querying a driving strategy engine of the train pacing system for an energy consumption impact for each stop of the one or more stops along the route of the requested train consist.

9. The method of claim 8, wherein querying the driving strategy engine includes querying the train pacing model from the driving strategy engine in response to querying the driving strategy engine.

10. The method of claim 1, wherein operating the requested train consist according to the modified operating plan includes adjusting at least one of throttle settings or braking settings for one or more locomotives included in the requested train consist according to the modified operating plan.

11. The method of claim 1, wherein operating the requested train consist according to the modified operating plan includes at least one of:

avoiding stopping the requested train consist at the particular location, or avoiding slowing down movement of the requested train consist at the particular location.

12. The method of claim 1, wherein querying the train pacing system for the energy consumption impact for each stop of the one or more stops along the route of the requested train consist includes querying a train pacing model for the energy consumption impact for each stop of the one or more stops along the route of the requested train consist.

13. A system for pacing movement of a train consist, the system comprising:

a processor; and a memory operably connected to the processor, the memory storing instructions which, when executed by the processor, cause the processor to perform operations, comprising:

receiving a request for a train consist including one or more railway cars and one or more locomotives;

receiving one or more operating parameters for the requested train consist;

determining an operating plan for the requested train consist based on the one or more operating parameters, the operating plan including one or more stops along a route of the requested train consist;

querying a train pacing system for an energy consumption impact for each stop of the one or more stops along a route of the requested train consist;

determining that at least one stop of the one or more stops is associated with an energy consumption impact that exceeds a prescribed energy consumption impact for the requested train consist;

modifying the determined operating plan to include changes of a stop location for the at least one stop to a different location so that an overall energy consumption for the requested train consist does not exceed a prescribed overall energy consumption; and operating the requested train consist according to the modified determined operating plan.

14. The system of claim 13, wherein the operations further comprise:

transmitting the modified determined operating plan to a locomotive of the requested train consist.

15. The system of claim 14, further comprising:

a processor on board the locomotive;

a locomotive memory operably connected to the processor on board the locomotive, the locomotive memory storing instructions which, when executed by the processor on board the locomotive, cause the processor onboard the locomotive to perform operations, comprising:

receiving the modified determined operating plan;

automating operation of the locomotive, including automation of locomotive throttling and braking settings to operate the locomotive according to the modified determined operating plan;

storing energy consumption information for the requested train consist along the route of the requested train consist; and transmitting the stored energy consumption information to the network planning system for use in determining an operating plan for one or more subsequent train consists.

16. The system of claim 13, wherein operating the requested train consist according to the modified determined operating plan includes:

stopping the requested train consist at the different location, and avoiding at least one of:

stopping the requested train consist at the stop location, or slowing down movement of the requested train consist at the stop location.

17. A method comprising:

at a train pacing model, receiving energy consumption information from one or more completed or in-process train consist runs;

determining an energy consumption associated with bringing the one or more completed or in-process train consist runs to a stop at each stop of one or more stops along routes of the one or more completed or in-process train consist runs and for accelerating the one or more completed or in-process train consist runs to desired operating speeds after bringing the one or more completed or in-process train consist runs to a stop;

determining an energy consumption impact as a ratio of the determined energy consumption to an overall energy consumption required for operating the requested train consist according to a modified operating plan without the stop for which the energy consumption is determined;

updating the train pacing model with the generated energy consumption impacts;

receiving a query for energy consumption impacts for bringing a requested train consist to one or more stops and for accelerating the requested train consist to a desired operating speed after the one or more stops;

executing the query at the train pacing model to provide energy consumption impacts associated with operating the requested train consist according to the one or more stops of the requested train consist;

based on the energy consumption impact for at least one stop of the one or more stops along a route of the requested train consist exceeding a prescribed energy consumption impact, modifying the operating plan to move a particular location of the at least one stop to a different stop location where an energy consumption impact for the different stop location does not exceed the prescribed energy consumption impact; and causing the requested train consist to operate according to the modified operating plan.

18. The method of claim 17, wherein receiving the query for the energy consumption impacts for bringing the requested train consist to the one or more stops and for accelerating the requested train consist to the desired operating speed after the one or more stops includes:

receiving a query at a driving strategy engine for an energy consumption impact for each of the one or more stops along the route of the requested train consist.

19. The method of claim 18, wherein in response to receiving a query at a driving strategy engine, passing the query to the train pacing model from the driving strategy engine.

20. The method of claim 17, wherein in response to executing the query at the train pacing model to provide the energy consumption impacts associated with operating the requested train consist according to the one or more stops of the requested train consist further comprises:

providing energy consumption impacts associated with operating the requested train consist according to the one or more stops of the requested train consist; and providing throttling and braking settings for one or more locomotives included in the requested train consist for operating the requested train consist according to the provided energy consumption impacts.

* * * * *